US008038471B2

(12) United States Patent
Malak

(10) Patent No.: US 8,038,471 B2
(45) Date of Patent: Oct. 18, 2011

(54) COAXIAL CABLE CONNECTOR

(75) Inventor: Stephen P. Malak, Manlius, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/867,720

(22) Filed: Oct. 5, 2007

(65) Prior Publication Data

US 2009/0093155 A1 Apr. 9, 2009

(51) Int. Cl.
*H01R 9/05* (2006.01)

(52) U.S. Cl. ..... 439/578

(58) Field of Classification Search ..... 439/578, 439/585, 142, 135
See application file for complete search history.

(56) References Cited

U.S. PATENT DOCUMENTS

| | | | | |
|---|---|---|---|---|
| 3,387,252 | A * | 6/1968 | Rothweiler | 439/148 |
| 4,365,858 | A * | 12/1982 | Karol | 439/135 |
| 4,731,032 | A * | 3/1988 | Noorily | 439/136 |
| 4,745,883 | A * | 5/1988 | Baggetta | 119/770 |
| 4,834,675 | A | 5/1989 | Samchisen | |
| 4,902,246 | A | 2/1990 | Samchisen | |
| 5,470,257 | A | 11/1995 | Szegda | |
| 5,533,912 | A * | 7/1996 | Fillinger et al. | 439/521 |
| 5,769,662 | A | 6/1998 | Stabile et al. | |
| 5,800,211 | A | 9/1998 | Stabile et al. | |
| 6,089,912 | A | 7/2000 | Tallis et al. | |
| 7,008,263 | B2 | 3/2006 | Holland | |
| 7,252,546 | B1 | 8/2007 | Holland | |
| 2005/0233636 | A1 | 10/2005 | Rodrigues et al. | |
| 2006/0148329 | A1 * | 7/2006 | Zahnen et al. | 439/709 |
| 2006/0289713 | A1 * | 12/2006 | Kaplan et al. | 248/311.2 |
| 2007/0259570 | A1 * | 11/2007 | Moshayedi | 439/638 |

FOREIGN PATENT DOCUMENTS

KR 20-0432574 11/2006

* cited by examiner

*Primary Examiner* — Alexander Gilman
(74) *Attorney, Agent, or Firm* — Schmeiser, Olsen & Watts, LLP

(57) ABSTRACT

An improved connector for coaxial cables includes a connector body, a compression sleeve and an attachment connecting the compression sleeve and the connector body. The attachment has a length defined to permit insertion of the compression sleeve into the connector body without having to detach the compression sleeve from the attachment.

13 Claims, 5 Drawing Sheets

COAXIAL CABLE CONNECTOR

FIELD OF THE INVENTION

The invention relates generally to electrical connectors and more particularly, to coaxial cable connectors.

BACKGROUND OF THE INVENTION

The conventional coaxial cable typically consists of a centrally located, inner electrical conductor surrounded by and spaced inwardly from an outer cylindrical electrical conductor. The center and outer conductors are separated by a dielectric insulating sleeve, and the outer conductor is encased within a protective dielectric jacket. The outer conductor can comprise a sheath of fine braided metallic strands, a metallic foil, or multiple layer combinations of either or both.

Coaxial cable connectors are known in the art and typically include a connector body, nut, post and compression sleeve made of electrically conductive materials. These F-type coaxial cable connectors are typically threaded onto an RF port to electrically integrate coaxial cables to various electronic devices such as TV's and the like. An example of such a connector is described in U.S. Pat. No. 5,470,257 to Szegda, herein incorporated by reference.

Snap together connectors, are known in the art and an example is described in U.S. Pat. Nos. 4,834,675 and 4,902,246 to Samchisen or U.S. Pat. No. 5,769,662 to Stabile, et al. The Samchisen connector has a compression sleeve with an annular attachment integrally formed with one end of the sleeve. The annular attachment is also sized to fit within a shoulder portion of the connector body. This permits the compression sleeve to be packaged in combination with the connector body. To install this connector to the coaxial cable, the compression sleeve is slid over one end of the cable. The cable is then prepared by removing a portion of the cable jacket and folding the braided shield back to expose the dielectric insulation and center conductor. The compression sleeve is then separated from the connector body and the cable is inserted into the connector body. The compression sleeve is then pushed into the body until the cable is secured within the connector body and the installation is complete. The Stabile connector has a compression sleeve with a retaining ring integrally formed with one end of the compression sleeve. The retaining ring is sized to fit within a flat exterior surface of the connector body. This permits the compression sleeve to be maintained as part of the connector assembly prior to assembly of the connector. The retaining ring is disengageable from the compression sleeve prior to and during installation of the coaxial cable within the connector body.

Although this connector facilitates pre-installation handling and storage, the reality is that even in this instance the user can accidentally drop or lose the compression sleeve once it is separated from the connector body. During the installation of the connector shown in U.S. Pat. Nos. 4,834,675 and 4,902,246 and 5,769,662 the compression sleeve must be detached from the connector body. Thus, mishandling or loss of the compression sleeve remains a serious problem during the critical installation phase, especially if the user is located in an awkward area, such as on a telephone pole.

In light of the foregoing, an objective of the present invention is the provision of an improved connector wherein the compression sleeve is not separated from the attachment during installation of the cable to the connector body. The compression sleeve remains at all times connected to the attachment prior to, during and after installation. Accordingly, this will ensure that the compression sleeve will never be lost.

SUMMARY OF THE INVENTION

A first aspect of the present invention provides a coaxial cable connector for connecting a coaxial cable to an RF port, the coaxial cable connector comprising: a connector body having a first end and a second end, the connector body comprising a tubular inner post extending from a front end to a rear end, the tubular inner post is mounted to the connector body at the front end, the connector body having defined therein an annular inner chamber at the second end; a fastener member mounted at the front end of the inner post configured to attach the coaxial cable connector to the RF port; a compression sleeve having a first compression sleeve end and a second compression sleeve end, the compression sleeve having a compression sleeve outer surface and a compression sleeve internal passageway defined therein, the compression sleeve configured for insertion into an opening of the annular inner chamber; and, an attachment having a attachment end and an attachment extension portion, the attachment end mounted to an outer surface of the connector body and the attachment extension portion attached to a portion of an outer surface of the compression sleeve, the attachment extension portion having a defined length to permit insertion of the compression sleeve into the annular inner chamber opening without having to detach the compression sleeve from the attachment.

A second aspect of the present invention provides: a coaxial cable connector for connecting a coaxial cable to an RF port, the coaxial cable connector comprising: a connector body having a first connector body end and a second connector body end, the connector body having a connector body internal passageway defined therein; fastener means proximate the first connector body end for attaching the connector to the RF port; a compression sleeve having a first compression sleeve end and a second compression sleeve end, the first compression sleeve end configured for insertion into the connector body internal passageway; and, attachment means connecting the compression sleeve to the connector body, the attachment means having an attachment end and an attachment extension portion, the attachment extension portion connected to the compression sleeve and the attachment end connected to the connector body, the attachment extension portion dimensioned to permit insertion of the first compression sleeve end into the connector body internal passageway without having to detach the compression sleeve from the attachment.

A third aspect of the present invention provides: an attachment for connecting a compression sleeve to a coaxial cable connector, the coaxial cable connector having a connector body with an internal passageway defined therein, a tubular inner post disposed within the internal passageway, a fastener member at the front end of the tubular inner post, the compression sleeve having an outer surface configured to be inserted into the internal passageway, the attachment comprising: a first attachment end mounted to an outer surface of the connector body; a second attachment end mounted to an outer surface of the compression sleeve; an attachment extension portion between the first attachment end and the second attachment end, the attachment extension portion dimensioned to permit insertion of the compression sleeve into the internal passageway.

A fourth aspect of the present invention provides a method for attaching a coaxial cable to a coaxial cable connector, the coaxial cable having a center conductor surrounded by a dielectric sleeve, the dielectric sleeve surrounded by an outer conductor, the outer conductor surrounded by a cable jacket, the coaxial cable connector having a connector body with an internal passageway defined therein, a tubular inner post is defined within the internal passageway, a fastener member is attached at a front end of the tubular inner post, the coaxial cable connector further having a compression sleeve configured to be inserted into the internal passageway and an attachment coupled between the compression sleeve and the connector body, comprising the steps of: inserting an end of the coaxial cable first into the compression sleeve and then into the connector body internal passageway; engaging the coaxial cable with the tubular inner post; inserting the compression sleeve into the connector body internal passageway; and, axially advancing the compression sleeve towards the fastener to compress the compression sleeve radially inwardly against the outer conductor and cable jacket, wherein the attachment remains coupled between the compression sleeve and the connector body during the axial advancement of the compression sleeve.

Other objects and features of the invention will become apparent as the description proceeds, especially when taken in conjunction with the accompanying drawings illustrating the invention, of which there are 4 sheets of drawings.

DESCRIPTION OF THE PREFERRED EMBODIMENT(S)

Figure 1:
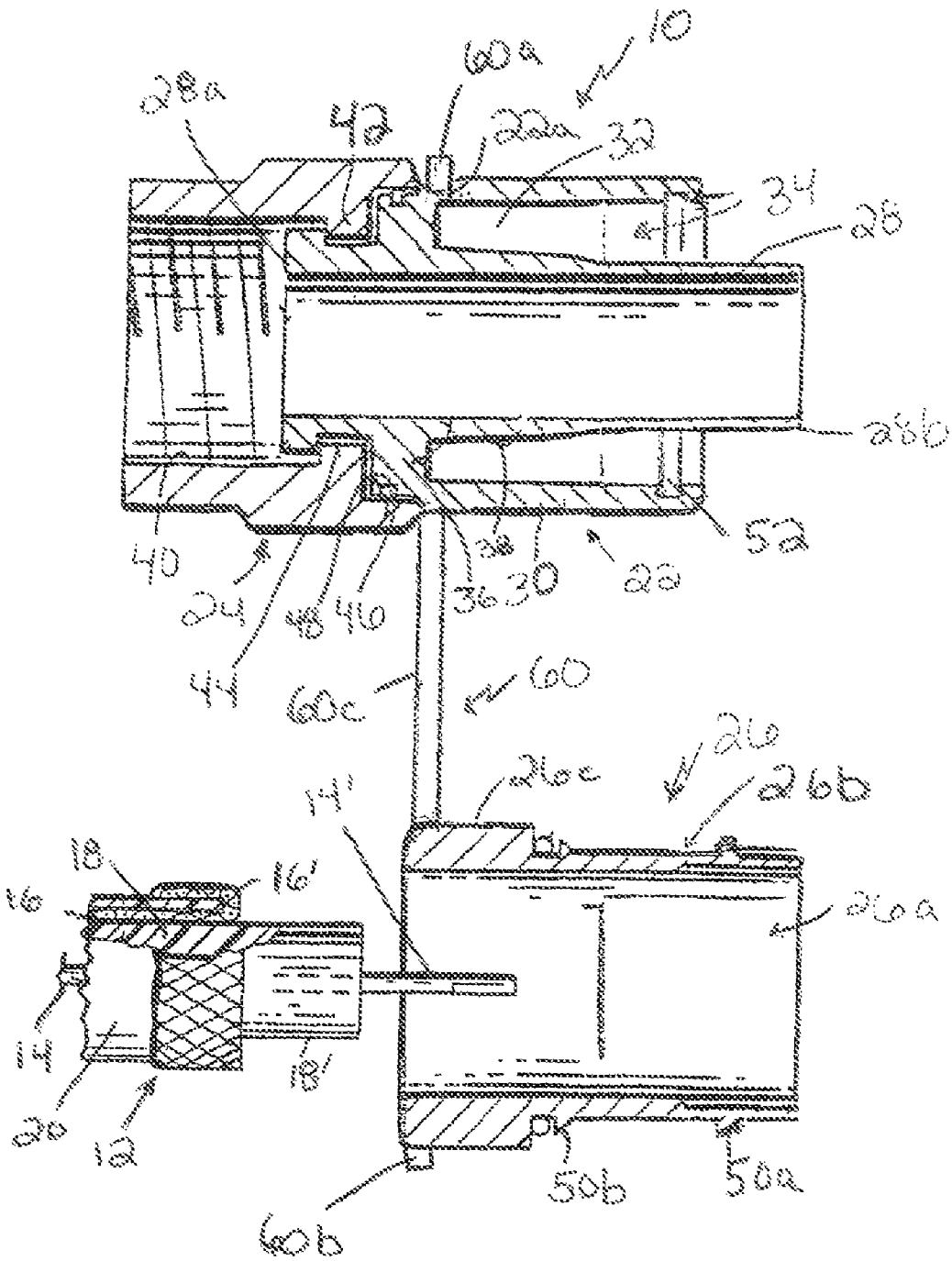
FIG. 1 depicts a side cross-sectional view of a coaxial cable connector with a first attachment embodiment and shown adjacent to the prepared end of a coaxial cable.

Referring initially to FIG. 1, a coaxial cable connector of the present invention is generally depicted in one form at 10 adjacent to the prepared end of a coaxial cable 12. Cable 12 is of a known type comprising an electrical center conductor 14 surrounded by and spaced radially inwardly from an outer conductor 16 by a dielectric insulating sleeve 18. The outer conductor 16 can comprise a sheath of fine braided metallic strands, a metallic foil, or multiple layer combinations of either or both. A dielectric covering or jacket 20 surrounds the outer conductor 16 and comprises the outermost layer of the cable.

An end of the cable is prepared for insertion into the coaxial cable connector 10 by selectively removing various layers to progressively expose an end 14' of the inner conductor, an end 18' of the insulating sleeve, and an end portion 16' of the outer conductor folded over the insulating jacket 20.

Figure 2:
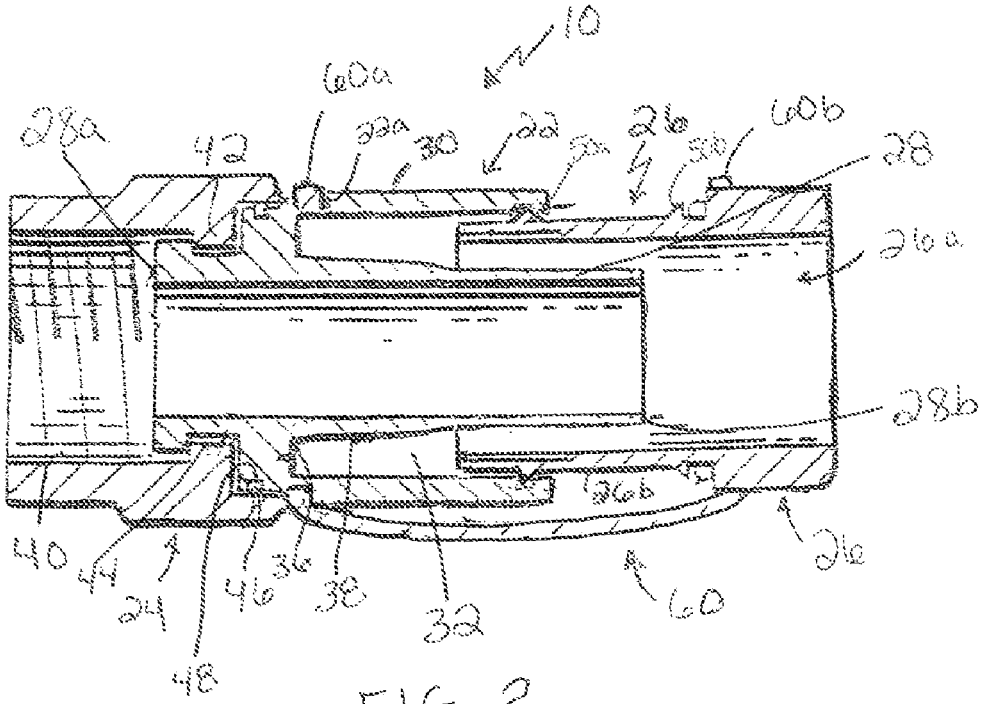
FIG. 2 depicts a side cross-sectional view of the coaxial cable connector of FIG. 1, the compression sleeve in an open position.
Figure 3:
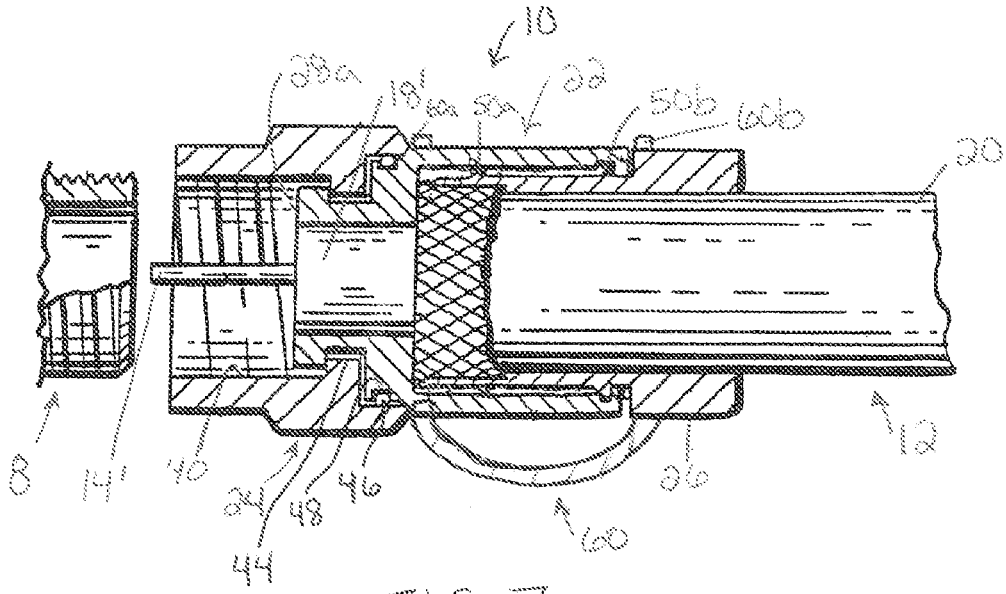
FIG. 3 depicts a side cross-sectional view of the coaxial cable connector of FIG. 1, the compression sleeve in a closed position.

Referring to FIGS. 1-3, coaxial cable connector 10 includes a connector body 22, a cylindrical fastener 24 and a compression sleeve 26. Connector body 22 comprises a tubular inner post 28 extending from a front end 28*a* to a rear end 28*b*, and an outer cylindrical collar 30 surrounding and fixed relative to the inner post 28 at a location disposed rearwardly of the front end 28*a*. Outer cylindrical collar 30 cooperates in a radially spaced relationship with the inner post 28 to define an annular chamber 32 accessible via a rear opening 34.

The outer collar 30 and the inner post 28 as shown are formed integrally as a single piece, with an integral circular flange 36 extending radially therebetween to close off the inner end of annular chamber 32. Alternatively, post 28 can be made as a separate piece and then mounted to the connector body having a mechanical interference fit. In this instance, the outer collar 30 and flange 36 can comprise a separate piece press fitted onto the outer surface of the inner post 28 (not shown).

The outer surface of the inner post 28 is configured with a radially enlarged or flared portion 38 within the annular chamber 32 and at a location proximate to the circular flange 36 and remote from the rear opening 34. Preferably, the flared portion defines a truncated conical surface with its maximum diameter closer in proximity to the circular flange 36 than to the rear opening 34.

In one form, the fastener 24 may be internally threaded as at 40 and may be provided with an inner circular shoulder 42 seated in a circular groove 44 in the outer surface of the inner post 28 at a location adjacent to the front end 28*a*. Fastener 24 may also have additional forms, such as a BNC or RCA-type interface and the like (not shown). The fastener 24 and inner post 28 are relatively rotatable, with an optional o-ring seal 46 seated in a second groove 48 and serving as a moisture barrier. As shown in FIG. 3, fastener 24 is configured to engage RF port 8.

Coaxial cable connector 10 further includes a compression sleeve 26 having an internal passageway 26*a*, a tapered outer surface 26*b* and a flanged outer surface 26*c*. The compression sleeve is preferably fabricated from a synthetic resinous plastic and configured to receive coaxial cable 12. One such resin, marketed under the tradename DELRIN (E.I. Du Pont de Nemours and Co.) may be used to fabricate compression sleeve 26. Compression sleeve 26 is configured to be inserted into opening 34 of the annular chamber 32. Engagement means, preferably first and second axially spaced radially protruding circular shoulders 50*a* and 50*b*, serve to couple the compression sleeve 26 to the connector body 22 between a first "open" position as seen in FIG. 2 and a second "closed" position as shown in FIG. 3.

Referring further to FIGS. 1-3, in a first embodiment, connector 10 includes an attachment 60 having a first attachment end 60*a*, a second attachment end 60*b* and an attachment extension portion 60*c*. Second attachment end 60*b* can in one configuration be integrally formed with compression sleeve flanged outer surface 26*c*. First attachment end 60*a* is configured to be mounted to connector body shoulder 22*a* of outer collar 30. Attachment 60 is preferably made of the same material as compression sleeve 26. First attachment end 60*a* and second attachment end 60*b* can in one configuration, shown in FIG. 5, be a ring that conforms to the generally circular cross-sections of connector body 22 and compression sleeve 26. Attachment extension portion 60*c* is of a length defined to permit the compression sleeve 26 to be inserted within the connector body 22 without being detached from the attachment 60, as shown in FIG. 2.

Figure 4:
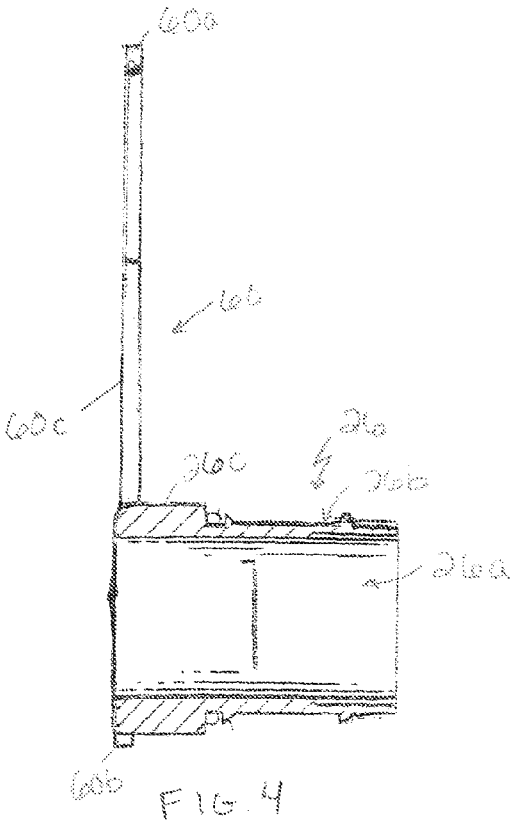
FIG. 4 depicts a side cross-section view of the first attachment embodiment of FIG. 1, attached to the compression sleeve.
Figure 5:
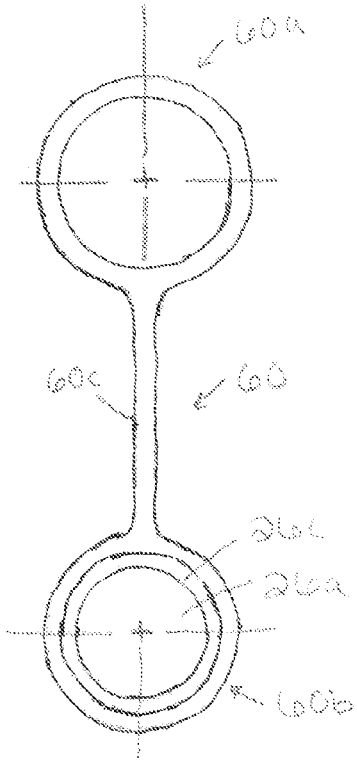
FIG. 5 depicts a front cross-sectional view of the attachment of FIG. 4.

Referring to FIGS. 4-5, attachment 60 is shown with second attachment end 60*b* integrally formed with the compression sleeve flanged outer surface 26*d*. As shown in FIG. 5, first attachment end 60*a* and second attachment end 60*b* are configured to closely conform to the connector body shoulder 22*a* of outer collar 30 and compression sleeve flanged outer surface 26*c*, respectively.

Figure 6:
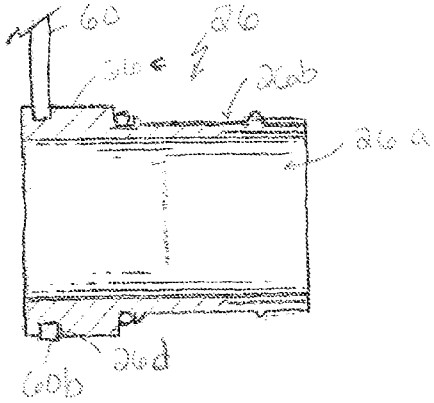
FIG. 6 depicts a side cross-sectional view of a second attachment embodiment attached to the compression sleeve.

Referring to FIG. 6, is a second embodiment of attachment 60. In this embodiment, compression sleeve 26 has a compression sleeve annular groove 26*d* located on the compression sleeve flanged outer surface 26*c*. Second attachment end 60*b* is configured to be mounted to the outer surface of the compression sleeve, and in one form this could be compression sleeve annular groove 26*d*, thus permitting a more secure attachment with the compression sleeve.

Figure 8B:
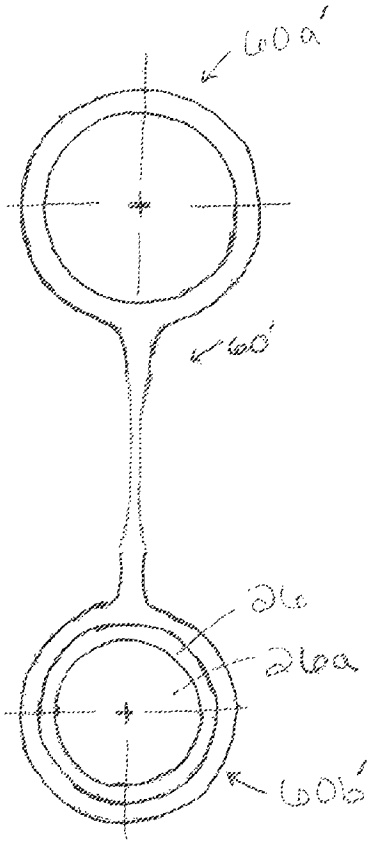
FIG. 8B depicts a front cross-sectional view of a third attachment embodiment of FIG. 7 in a stretched position.
Figure 8A:
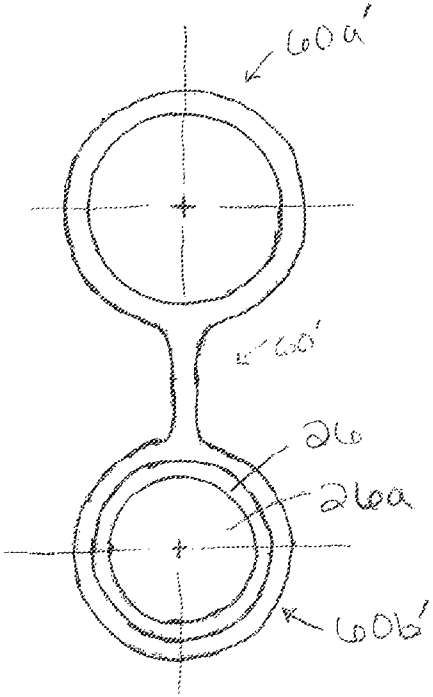
FIG. 8A depicts a front cross-sectional view of the third attachment embodiment of FIG. 7 in an unstretched position.
Figure 7:
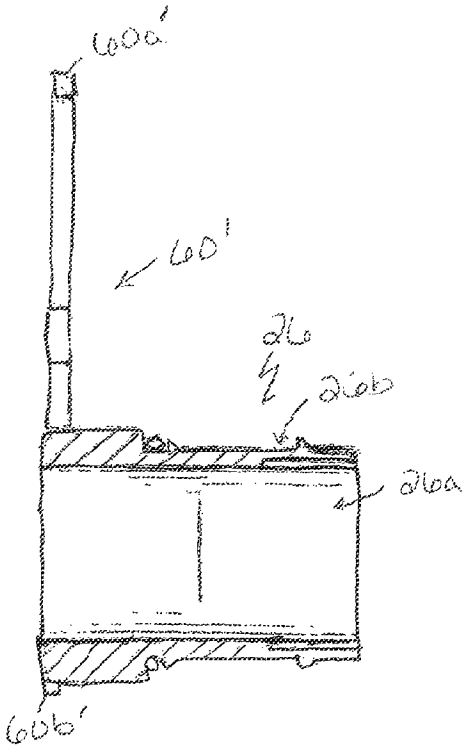
FIG. 7 depicts a side cross-sectional view of a third attachment embodiment attached to the compression sleeve.

Referring to FIG. 7-8, is a third embodiment of an attachment 60' having a first elastic attachment end 60*a*', an elastic attachment portion 60*b*' and an elastic attachment extension portion 60*c*'. In this embodiment, attachment 60' is made of an elasticized material, such as a rubber band and the like. The attachment extension portion 60*c*' is relatively short but configured to stretch as necessary to a defined length in order to insert the compression sleeve 26 in the connector body 22 without detaching the compression sleeve 26 from the elasticized attachment 60'. This is depicted in FIGS. 8A and 8B, showing the elastic extension portion 60*c*' stretching between centerlines. In this arrangement, the elastic attachment 60' will stretch and be in close proximity to the connector body 22 upon insertion of the compression sleeve 26 into the connector body 22. In addition, the second elastic attachment end 60*b*' could be configured to fit within compression sleeve annular groove 26*d* (not shown).

An exemplary method for installing the assembled connector 10 to the coaxial cable 12 is shown in FIGS. 1-3. Although the end of cable 12 depicted in FIG. 1 is already prepared prior to engaging compression sleeve 26, the end of cable 12 could be inserted into the compression sleeve first and then prepared. Referring to FIG. 1, an end of coaxial cable 12 has been prepared by removing a portion of the cable jacket 20 and folding the braided shield 16 back to expose the dielectric insulating sleeve 18 and the center conductor 15. The prepared end of cable 12 is then inserted into the compression sleeve internal passageway 26*a*. Compression sleeve 26 remains attached to the connector body 22 by the attachment 60.

The prepared end of cable 12 is then inserted into outer collar 30 until prepared end of dielectric insulating sleeve 18' is flush with tubular inner post front end 28*a* as shown in FIG. 3. At the same time first protruding circular shoulder 50*a* serves to couple the compression sleeve in the connector body in a first open position, as shown in FIG. 2. Compression sleeve 26 remains attached to the connector body 22 through attachment 60.

As shown in FIG. 3, the compression sleeve 26 is then axially advanced, causing circular shoulder 50*a* to disengage from groove 52. Braided shield 16 and cable jacket 20 are then compressed radially inwardly between the compression sleeve 26 and flared portion 38 of tubular inner post 28. Final locking occurs when the second circular shoulder 50*b* coacts in snapped engagement with groove 52. Compression sleeve 26 remains attached to the connector body 22 through attachment 60. Attachment connecting portion 60*c* is in close proximity to the connector body 22.

Although the exemplary method of installing connector 10 to cable 12 as described previously refers to the first attachment embodiment, it should be noted that the method is substantially similar for the second and third attachment embodiments.

While I have illustrated and described preferred embodiments of my invention, it is understood that this is capable of modifications, and I therefore do not wish to be limited to precise details set forth, but desire to avail myself of such changes and alterations as fall within the purview of the following claims.

I claim:

1. A coaxial cable connector for connecting a coaxial cable having a center conductor surrounded by a dielectric sleeve, the dielectric sleeve surrounded by an outer conductor, the outer conductor surrounded by a cable jacket to an RE port, the coaxial cable connector comprising:

a connector body having a first end and a second end, the connector body having a tubular inner post extending from a front end to a rear end, the tubular inner post mounted to the connector body at the front end, the connector body having defined therein an annular inner chamber at the second end;

a fastener mounted at the front end of the inner post configured to attach the coaxial cable connector to the RF port;

a compression sleeve having a first compression sleeve end and a second compression sleeve end, the compression sleeve having a compression sleeve outer surface and a compression sleeve internal passageway defined therein, the coaxial cable configured for insertion into the compression sleeve internal passageway and the compression sleeve configured for insertion into an opening of the annular inner chamber, wherein the compression sleeve includes an annular groove in a flanged outer surface of the compression sleeve; and, a non-detachable attachment having a first attachment end, a second attachment end, and an attachment extension portion connecting the first attachment end and the second attachment end, the first attachment end mounted to an outer surface of the connector body and the second attachment end mounted within the annular groove in the flanged outer surface of the compression sleeve, the attachment extension portion having a defined length to permit insertion of the compression sleeve into the annular inner chamber opening;

wherein the first attachment end of the non-detachable attachment is a ring that conforms to a cross-section of the connector body and the second attachment end of the non-detachable attachment is a ring that conforms to a cross-section of the compression sleeve at the annular groove.

2. The coaxial cable connector of claim 1, wherein the first attachment end fits into a connector body annular groove on the connector body.

3. The coaxial cable connector of claim 1, wherein the non-detachable attachment is comprised of an elastic material configured to stretch to the defined length as the compression sleeve is inserted into the annular inner chamber opening.

4. A coaxial cable connector for connecting a coaxial cable having a center conductor surrounded by a dielectric sleeve, the dielectric sleeve surrounded by an outer conductor, the outer conductor surrounded by a cable jacket to an RF port, the coaxial cable connector comprising:

a connector body having a first connector body end and a second connector body end, the connector body having a connector body internal passageway defined therein;

fastener means mounted to the first connector body end for attaching the connector to the RF port;

a compression sleeve having a first compression sleeve end and a second compression sleeve end, the first compression sleeve end configured for insertion into the connector body internal passageway and the compression sleeve further configured to receive the coaxial cable, wherein the compression sleeve includes an annular groove in a flanged outer surface of the compression sleeve; and, non-detachable attachment means connecting the compression sleeve to the connector body, the non-detachable attachment means having an attachment end and an attachment extension portion, the attachment extension portion connected to the compression sleeve by surrounding the compression sleeve within the annular groove and the attachment end connected to the connector body, the attachment extension portion dimensioned to permit insertion of the first compression sleeve end into the connector body internal passageway.

5. The coaxial cable connector of claim 4, wherein the attachment extension portion includes an elastic length portion.

6. The coaxial cable connector of claim 5, wherein the elastic length portion is configured to stretch to a defined length to permit insertion of the first compression sleeve end into the connector body internal passageway.

7. A non-detachable attachment for connecting a compression sleeve to a coaxial cable connector, the coaxial cable connector having a connector body with an internal passageway defined therein, a tubular inner post disposed within the internal passageway, a fastener member at the front end of the tubular inner post, the compression sleeve having a compression sleeve outer surface configured to be inserted into the internal passageway and a compression sleeve internal passageway configured to receive a coaxial cable, the coaxial cable having a center conductor surrounded by a dielectric sleeve, the dielectric sleeve surrounded by an outer conductor, the outer conductor surrounded by a cable jacket, the non-detachable attachment comprising:

a first attachment end mounted to a first outer surface of the connector body;

a second attachment end mounted to the compression sleeve outer surface; and an attachment extension portion between the first attachment end and the second attachment end, the attachment extension portion dimensioned to permit insertion of the compression sleeve into the internal passageway;

wherein the first attachment end of the non-detachable attachment is a ring that conforms to a cross-section of the connector body and the second attachment end of the non-detachable attachment is a ring that conforms to a cross-section of the compression sleeve.

8. The attachment of claim 7, wherein the attachment extension portion includes an elastic length portion configured to stretch to a defined length to permit insertion of the compression sleeve into the internal passageway.

9. The attachment of claim 7, wherein the first attachment end is mounted to an annular groove on an outer surface of the connector body.

10. A method for attaching a coaxial cable to a coaxial cable connector, the coaxial cable having a center conductor surrounded by a dielectric sleeve, the dielectric sleeve surrounded by an outer conductor, the outer conductor surrounded by a cable jacket, the coaxial cable connector having a connector body with an internal passageway defined therein, a tubular inner post defined within the internal passageway, a fastener member mounted at a front end of the tubular inner post, the coaxial cable connector further having a compression sleeve having an annular groove in a flanged outer surface configured to be inserted into the internal passageway and a non-detachable attachment coupled between the compression sleeve and the connector body, comprising the steps of:

inserting an end of the coaxial cable first into the compression sleeve and then into the connector body internal passageway;

engaging the coaxial cable with the tubular inner post until the dielectric sleeve engages the front end of the tubular inner post;

inserting the compression sleeve into the connector body internal passageway; and, axially advancing the compression sleeve towards the fastener to compress the compression sleeve radially inwardly against the outer conductor and cable jacket, wherein the non-detachable attachment remains coupled between the compression sleeve and the connector body during the axial advancement of the compression sleeve.

11. A method as recited in claim 10, wherein the step of inserting an end of the coaxial cable first into the compression sleeve and then into the connector body internal passageway further includes preparing the end of the coaxial cable.

12. A method as recited in claim 10, wherein the step of inserting the compression sleeve into the connector body internal passageway further includes engaging a first shoulder on the compression sleeve with a groove in the connector body internal passageway.

13. A method as recited in claim 12, wherein the step of inserting the compression sleeve into the connector body internal passageway further includes stretching an extension portion of the non-detachable attachment to a defined length.

* * * * *